United States Patent [19]

Yasunaga et al.

[11] Patent Number: 4,610,553

[45] Date of Patent: Sep. 9, 1986

[54] LEAF SPRING UNIT FOR A DOT MATRIX PRINTER

[75] Inventors: Makoto Yasunaga; Tsutomu Ikehata, both of Tanashi, Japan

[73] Assignee: Citizen Watch Co., Ltd., Tokyo, Japan

[21] Appl. No.: 657,195

[22] Filed: Oct. 3, 1984

[30] Foreign Application Priority Data

Oct. 8, 1983 [JP] Japan ..... 58-156611[U]
Oct. 8, 1983 [JP] Japan ..... 58-188898

[51] Int. Cl.[4] ..... B41J 3/10
[52] U.S. Cl. ..... 400/124; 101/93.05
[58] Field of Search ..... 101/93.04, 93.05, 93.48; 400/124

[56] References Cited

U.S. PATENT DOCUMENTS 3,896,918 7/1975 Schneider ..... 101/93.05 X
4,304,495 12/1981 Wada et al. ..... 400/124
4,389,127 6/1983 Bellinger ..... 101/93.05 X

FOREIGN PATENT DOCUMENTS 2848639 6/1979 Fed. Rep. of Germany ..... 400/124 WD
0022075 2/1982 Japan ..... 400/124
0152960 9/1982 Japan ..... 400/124

*Primary Examiner*—Edgar S. Burr
*Assistant Examiner*—John A. Weresh
*Attorney, Agent, or Firm*—Birch, Stewart, Kolasch & Birch

[57] ABSTRACT

A leaf spring unit has a leaf spring cantilevered on a supporting member, an armature secured to one side of a free end portion of the leaf spring, and a wire secured to the armature. A reinforcement plate is secured to the other side of the leaf spring opposite to the armature. An inner edge of the reinforcement plate is inwardly extended from the inner side of the armature so as to reinforce a part of the leaf spring.

5 Claims, 6 Drawing Figures

LEAF SPRING UNIT FOR A DOT MATRIX PRINTER

BACKGROUND OF THE INVENTION

The present invention relates to a leaf spring unit employed in a printing head of a dot matrix printer, and more particularly to a leaf spring having a print wire for a printer of the type in which the spring is prestressed by a permanent magnet.

FIG. 1 shows a conventional leaf spring unit disclosed, for example in U.S. Pat. No. 4,348,120. The leaf spring unit comprises a leaf spring 1 cantilevered on a supporting member 2, an armature 3 secured to a free end portion 1*a* of the leaf spring 1, and a print wire 4 mounted on the armature 3. A core 5 having an exciting coil (not shown) is disposed adjacent to the free end portion 1*a* of the leaf spring 1 at a rear side thereof.

At a waiting position, the armature 3 secured to the leaf spring 1 is attracted to the core 5 by magnetic force of a permanent magnet (not shown) against the elasticity of the leaf spring 1. When the coil provided on the core 5 is excited, the flux of the permanent magnet is canceled so that the print wire 4 is driven forward by the elastic force of the leaf spring 1 to print a dot. Thus, the leaf spring 1 is reciprocated between the printing position and the reset position.

Since the armature 3 has a large thickness, an end part of the leaf spring 1 where the armature is secured acts as a stiff arm and a residual portion 1*b* acts as a flexible arm. Thus, a border portion 1*c* adjacent the armature or an end portion of the flexible portion 1*b* is greatly bent during the operation. In other words, the cross section of the bent portion largely changes in area. This causes a concentration of stress to the border portion 1*c*. Further, when the print wire 4 impacts a platen (not shown), the border portion 1*c* overreaches the nuetral position as shown in dotted-dashed line in FIG. 1, because of a large mass in a portion around the border portion 1*c*. Accordingly, excessive tensile stress develops in the portion 1*c*. As a result, the leaf spring 1 is broken after being in use for a short period.

FIG. 2 shows another leaf spring unit in which a leaf spring 6 is engaged with a groove 7*a* provided in an armature 7. However, end surfaces 7*b*, 7*c* of the armature 7 are in line with each other. Therefore, large tensile stress also develops in a border portion 6*c*.

SUMMARY OF THE INVENTION

The object of the present invention is to provide a leaf spring unit for a dot matrix printer having high reliability and durability without causing damage to a leaf spring.

According to the present invention, there is provided a leaf spring unit for a dot matrix printer, having a leaf spring cantilevered on a supporting member, an armature secured to one side of a free end portion of the leaf spring, and a wire secured to the armature. A reinforcement plate is secured to the other side of the leaf spring, opposite to the armature. An inner edge of the reinforcement plate is inwardly extended from the inner side of the armature so as to reinforce a part of the leaf spring.

In another aspect of the present invention, the reinforcement member is integral with the armature.

In a further aspect of the present invention, the armature has a hole and is secured to the leaf spring by brazing of filler metal preplaced in the hole.

These and other objects and features of the present invention will become more apparent from the following description with reference to the accompanying drawings.

DESCRIPTION OF THE PREFERRED EMBODIMENTS

Figure 1:
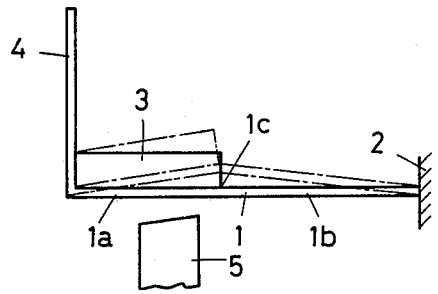
FIG. 1 PRIOR ART
FIGS. 1 and 2 are side views of conventional leaf spring units.
Figure 2:
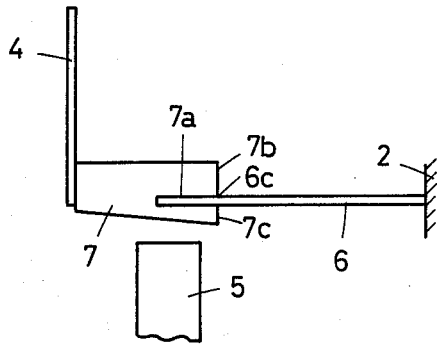
FIG. 2 PRIOR ART
Figure 3:
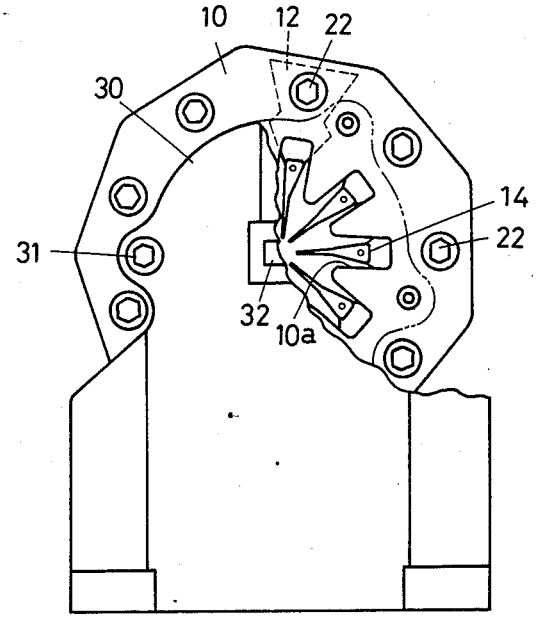
FIG. 3 is a front view of a printing head of a dot matrix printer provided with leaf spring units according to the present invention, a part of which is broken away.
Figure 4:
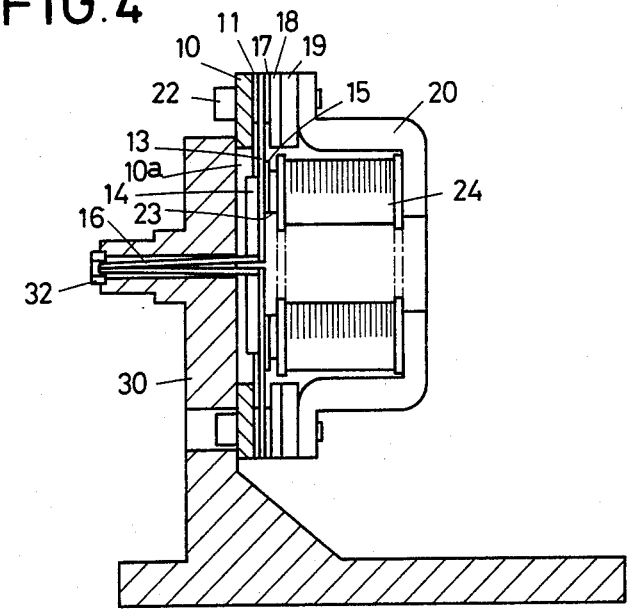
FIG. 4 is a sectional side view of FIG. 3.
Figure 5:
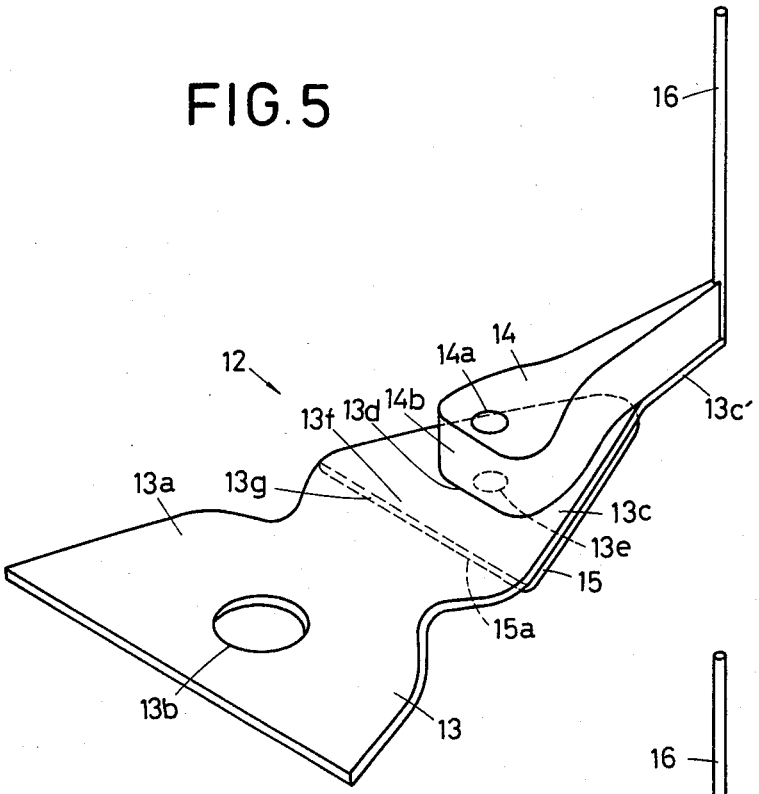
FIG. 5 is a perspective view of a leaf spring unit of the present invention.

Referring to FIGS. 3 to 5, a supporting member 10 for a print wire driving apparatus is mounted on a frame 30 made of non-magnetic material by screws 31. A plurality of leaf spring units 12 are circularly disposed on the rear side of the supporting member 10 interposing a spacer 11.

Referring to FIG. 5, each leaf spring unit 12 comprises a leaf spring 13 comprising a flexible spring portion 13*a* having a hole 13*b* and a free end portion 13*c* having a pointed end 13*c*', an armature 14 secured to the free end portion 13*c* of the leaf spring 13, a reinforcement plate 15 secured to the leaf spring 13 on the rear side of the leaf spring 13 opposite to the armature 14, and a print wire 16 securely mounted on the tip end of the armature 14. The reinforcement plate 15 has a thinner thickness than the leaf spring 13 and is formed in the same contour as the free end portion 13*c* except for the pointed end 13*c*'. An inner edge 15*a* of the reinforcement plate is inwardly extended from a border portion 13*d* adjacent to the lower edge of the inner side 14*b* of the armature so as to reinforce a part of flexible spring portion 13*a* including the border portion 13*d*.

The armature 14, leaf spring 13 and reinforcement plate 15 are temporarily adhered each other before brazing by a suitable manner such as spot welding.

A hole 14*a* penetrates armature 14 and a hole 13*e* corresponding to the hole 14*a* is formed in the free end portion 13*c* of the leaf spring 13. In order to attach the armature 14 and reinforcement plate 15 to the leaf spring 13, preplaced brazing method is employed as described hereinafter. Brazing filler metal is inserted into holes 14*a* and 13*e* and put on the reinforcement plate 15. During the brazing operation in a furnace, melted filler metal flows into the space between armature 14 and leaf spring 13 and the space between the leaf sping 13 and reinforcement plate 15 so that those members are secured each other. The amount of the filler metal is determined such a value that the melted metal does not flow out from the armature. If the filler metal exists on the leaf spring outside the armature, the filler metal obstructs the flux of the magnetic circuit. In accordance with the present invention, since brazing filler metal is put in the hole 14*a*, the flow of the melted filler metal to the flexible spring portion can be easily prevented.

Referring to FIG. 4, on the rear side of each leaf spring 13, a magnet supporting plate 18 is disposed interposing a spacer 17. Mounted on the magnet supporting plate 18 is a permanent magnet 19, to the other side of which a yoke 20 is disposed. A core 23 is provided on each yoke 20 and disposed adjacent to the reinforcement plate 15 secured to the leaf spring 13. The spacer 11, leaf spring 13, spacer 17, magnet supporting plate 18, permanent magnet 19 and yoke 20 are integrally mounted on the supporting member 10 by a screw 22. A coil 24 wound on the core 23 is connected to an electric circuit (not shown). As shown in FIG. 3, the supporting member 10 has a plurality of notches 10*a* to form slight gaps surrounding armatures 14. End portions of print wires 16 are arranged on the straight in a print wire guide 32 provided on a projected end portion of the frame 30.

In operation, the magnetic circuit of flux produced by the magnetomotive force of the permanent magnet 19 is provided in the order of the magnet supporting plate 18, spacer 17, flexible spring portion 13*a* of leaf spring 13, spacer 11, supporting member 10, gap 10*a*, armature 14, free end portion 13*c* of leaf spring 13, reinforcement plate 15, core 23 and yoke 20. Thus, the armature 14 having print wire 16 is attracted to the core 23 against the elasticity of the spring 13. When, the coil 24 is excited for a predetermined period, the attraction between the core 23 and leaf spring 13 is canceled. Thus, the leaf spring 13 is driven by the elastic force of the spring and the print wire 16 impacts a paper (not shown) to print a dot.

In accordance with the present invention, a portion 13*f* of the leaf spring 13 between the border portion 13*d* and the edge 15*a* of the reinforcement plate 15 is reinforced by the reinforcement plate 15 so that stiffness of the portion 13*f* is increased. Thus, tensile stress developed in the border portion 13*d* is reduced. On the other hand, a free end 13*g* of the flexible spring portion 13*a* corresponding to the edge 15*a* of the reinforcement plate 15 is compressed at the impact stroke, so that compressive stress is developed in the free end portion. The compressive stress hardly causes the fatigue of the leaf spring, which ensures a long life time of the leaf spring. Since, no step is provided on the front side of the leaf spring in which tensile stress develops, the stress concentration does not occur. Thus, the breakdown of the leaf spring by the tensile stress can also be prevented.

Figure 6:
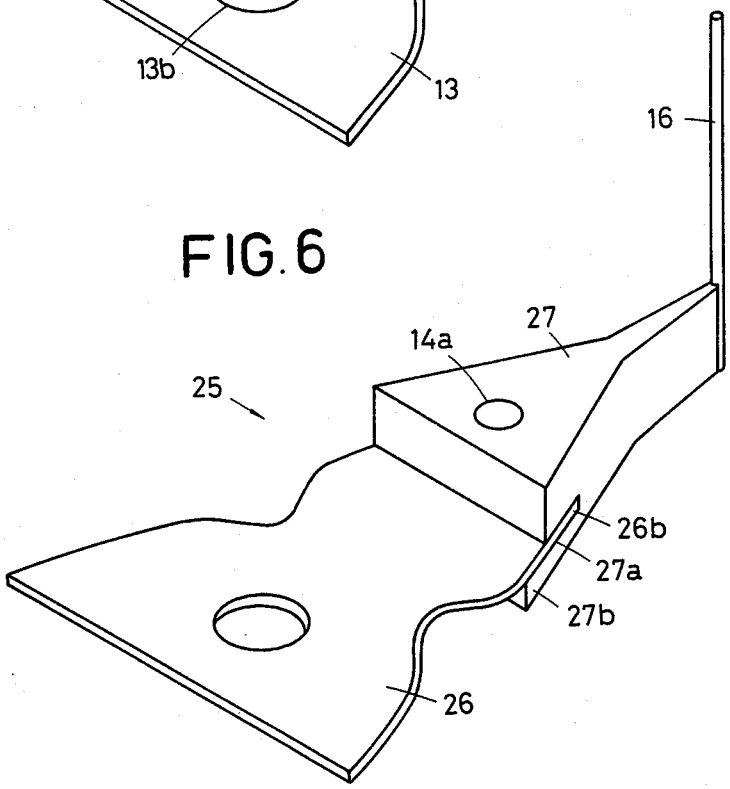
FIG. 6 is a perspective view showing another embodiment of the present invention.

FIG. 6 shows another embodiment of the present invention in which a leaf spring unit 25 is so arranged that the reinforcement plate 15 of FIG. 5 is integrally formed with the armature 14 of FIG. 5.

An armature 27 has a groove 27*a* for engaging a leaf spring 26 and an extending end portion 27*b* as a reinforcement plate. An end portion 26*b* of the leaf spring 26 is engaged with the groove 27*a* and secured thereto by preplaced brazing. Other parts are the same as the first embodiment and therefore the same parts are identified by the same reference numerals as the first embodiment. The embodiment also has the same advantages as the first embodiment.

While the invention has been described in conjunction with preferred specific embodiments thereof, it will be understood that this description is intended to illustrate and not limit the scope of the invention, which is defined by the following claims.

What is claimed is:

1. An improved leaf spring unit for a dot matrix printer, having a leaf spring cantilevered on a supporting member at a base end portion, an armature secured to a first side of a free end portion of said leaf spring and having an armature surface facing said base end portion, and a wire secured to an end of the armature opposite to said armature surface, a core for producing a magnetic field for attracting said leaf spring, wherein the improvement comprising:

a reinforcement member coextensive with a portion of said leaf spring and secured to a second side of said free end portion of said leaf spring opposite to said armature so as to be adjacent to the core, said reinforcement member having a thinner thickness than said armature and extending from an edge surface facing toward said leaf spring base end portion toward the free end of said leaf spring, said edge surface of said reinforcement member being closer to said base end portion than any portion of said armature surface so as to reinforce said leaf spring adjacent to said armature surface.

2. The leaf spring unit according to claim 1 wherein said reinforcement member is integral with said armature.

3. The leaf spring unit according to claim 1 wherein said reinforcement member has the same contour as the leaf spring except at its outer and inner end portions.

4. The leaf spring unit for a dot matrix printer according to claim 1 wherein said armature has a hole and is secured to said leaf spring by brazing of filler metal preplaced in said hole.

5. The leaf spring unit according to claim 4 wherein said leaf spring has a hole corresponding to said hole of said armature.

* * * * *